US011220805B2

(12) United States Patent
Kondo et al.

(10) Patent No.: US 11,220,805 B2
(45) Date of Patent: Jan. 11, 2022

(54) HYDRAULIC EXCAVATOR DRIVE SYSTEM

(71) Applicant: KAWASAKI JUKOGYO KABUSHIKI KAISHA, Kobe (JP)

(72) Inventors: Akihiro Kondo, Kobe (JP); Hideyasu Muraoka, Akashi (JP); Kazuya Iwabe, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/055,900

(22) PCT Filed: May 7, 2019

(86) PCT No.: PCT/JP2019/018275
§ 371 (c)(1),
(2) Date: Nov. 16, 2020

(87) PCT Pub. No.: WO2019/220954
PCT Pub. Date: Nov. 21, 2019

(65) Prior Publication Data

US 2021/0189691 A1 Jun. 24, 2021

(30) Foreign Application Priority Data

May 15, 2018 (JP) ..... JP2018-094012

(51) Int. Cl.
*E02F 9/22* (2006.01)
*F15B 11/042* (2006.01)
*F15B 11/17* (2006.01)

(52) U.S. Cl.
CPC ..... *E02F 9/2267* (2013.01); *E02F 9/2246* (2013.01); *E02F 9/2292* (2013.01); *F15B 11/042* (2013.01); *F15B 11/17* (2013.01)

(58) Field of Classification Search
CPC ..... E02F 9/2246; E02F 9/2292; F15B 11/17; F15B 11/042
See application file for complete search history.

(56) References Cited

U.S. PATENT DOCUMENTS 8,756,916 B2 * 6/2014 Sato ..... E02F 9/226 60/284
2016/0252107 A1 * 9/2016 Kondo ..... F15B 11/17 60/428

FOREIGN PATENT DOCUMENTS

EP 3128387 A1 2/2017
JP 6220227 B2 10/2017

* cited by examiner

*Primary Examiner* — Abiy Teka
(74) *Attorney, Agent, or Firm* — Oliff PLC

(57) ABSTRACT

A hydraulic excavator drive system includes: a first pump connected to a boom main control valve and an arm auxiliary control valve by a first pump line; a second pump connected to a boom auxiliary control valve and an arm main control valve by a second pump line; and a controller that does not move the arm auxiliary control valve when arm crowding operation boom raising operations are performed concurrently. The boom auxiliary control valve moves together with the boom main control valve when the boom raising operation is performed. A boom raising second supply line, which connects the boom auxiliary control valve to a boom raising first supply line between the boom main control valve and a boom cylinder, is provided with a check valve that allows a flow from the boom auxiliary control valve toward a head side of the boom cylinder, but prevents a reverse flow.

3 Claims, 6 Drawing Sheets

HYDRAULIC EXCAVATOR DRIVE SYSTEM

TECHNICAL FIELD

The present invention relates to a hydraulic excavator drive system.

BACKGROUND ART

In general, a hydraulic excavator drive system includes a slewing motor, a boom cylinder, an arm cylinder, and a bucket cylinder as hydraulic actuators. These hydraulic actuators are supplied with hydraulic oil from two pumps. Normally, each of the slewing motor and the bucket cylinder is supplied with the hydraulic oil from one of the pumps via one control valve, whereas each of the boom cylinder and the arm cylinder is supplied with the hydraulic oil from both of the pumps via two control valves.

For example, Patent Literature 1 discloses a hydraulic excavator drive system 100 shown in FIG. 6. The drive system 100 is configured to be able to prevent a large amount of hydraulic oil from flowing into one of the arm cylinder and the boom cylinder whose load pressure is lower when an arm crowding operation and a boom raising operation are performed concurrently.

Specifically, in the drive system 100, a boom main control valve 120 is connected to a boom cylinder 140 by a boom raising first supply line 121 and a boom lowering supply line 122, and a boom auxiliary control valve 130 is connected to the boom raising first supply line 121 by a boom raising second supply line 131. An arm main control valve 150 is connected to an arm cylinder 170 by an arm crowding first supply line 151 and an arm pushing first supply line 152. An arm auxiliary control valve 160 is connected to the arm crowding first supply line 151 by an arm crowding second supply line 161 and connected to the arm pushing first supply line 152 by an arm pushing second supply line 162.

The boom main control valve 120 moves in accordance with a pilot pressure outputted from a boom operation device 125, which is a pilot operation valve. On the other hand, the boom auxiliary control valve 130 is controlled by a controller 180 via a solenoid proportional valve 135. Similarly, the arm main control valve 150 moves in accordance with a pilot pressure outputted from an arm operation device 155, which is a pilot operation valve. On the other hand, the arm auxiliary control valve 160 is controlled by the controller 180 via a pair of solenoid proportional valves 165.

When a boom raising operation is performed without an arm crowding operation being performed, the controller 180 moves the boom auxiliary control valve 130 together with the boom main control valve 120. When a boom raising operation is performed concurrently with an arm crowding operation, the controller 180 does not move the boom auxiliary control valve 130. Similarly, when an arm crowding operation is performed without a boom raising operation being performed, the controller 180 moves the arm auxiliary control valve 160 together with the arm main control valve 150, and when an arm crowding operation is performed concurrently with a boom raising operation, the controller 180 does not move the arm auxiliary control valve 160. Owing to this configuration, when an arm crowding operation and a boom raising operation are performed concurrently, a first pump 111 can be used dedicatedly for the boom cylinder 140, and a second pump 112 can be used dedicatedly for the arm cylinder 170. Accordingly, as mentioned above, a large amount of hydraulic oil can be prevented from flowing into one of the arm cylinder 170 and the boom cylinder 140 whose load pressure is lower.

CITATION LIST

Patent Literature

PTL 1: Japanese Patent No. 6220227

SUMMARY OF INVENTION

Technical Problem

However, the drive system 100 shown in FIG. 6 requires three solenoid proportional valves dedicated for the boom auxiliary control valve 130 and the arm auxiliary control valve 160.

In view of the above, an object of the present invention is to provide a hydraulic excavator drive system that is capable of preventing, at a lower cost, a large amount of hydraulic oil from flowing into one of the arm cylinder and the boom cylinder whose load pressure is lower.

Solution to Problem

In order to solve the above-described problems, a hydraulic excavator drive system according to the present invention includes: a boom main control valve connected to a boom cylinder by a boom raising first supply line and a boom lowering supply line; a boom auxiliary control valve connected to the boom raising first supply line by a boom raising second supply line, the boom auxiliary control valve moving together with the boom main control valve when a boom raising operation is performed; an arm main control valve connected to an arm cylinder by an arm crowding first supply line and an arm pushing first supply line; an arm auxiliary control valve connected to the arm crowding first supply line by an arm crowding second supply line and connected to the arm pushing first supply line by an arm pushing second supply line; a first pump connected to the boom main control valve and the arm auxiliary control valve by a first pump line; a second pump connected to the boom auxiliary control valve and the arm main control valve by a second pump line; and a controller that controls the arm auxiliary control valve via a solenoid proportional valve at least when an arm crowding operation is performed, the controller moving the arm auxiliary control valve together with the arm main control valve when the arm crowding operation is performed without the boom raising operation being performed, but not moving the arm auxiliary control valve when the arm crowding operation and the boom raising operation are performed concurrently. The boom raising second supply line is provided with a check valve that allows a flow from the boom auxiliary control valve toward a head side of the boom cylinder, but prevents a reverse flow.

According to the above configuration, when the arm crowding operation and the boom raising operation are performed concurrently, the arm auxiliary control valve does not move. Therefore, the first pump can be used dedicatedly for the boom cylinder. On the other hand, regarding the second pump, normally, when the arm crowding operation and the boom raising operation are performed concurrently, the load pressure of the boom cylinder is higher than the load pressure of the arm cylinder. Accordingly, even when the boom auxiliary control valve moves together with the boom main control valve, the check valve provided on the boom raising second supply line blocks the supply of the hydraulic oil from the boom auxiliary control valve to the boom cylinder. Therefore, the second pump can be used dedicatedly for the arm cylinder. That is, according to the present invention, the number of solenoid proportional valves can be reduced by 1 compared to the conventional hydraulic excavator drive system. This makes it possible to prevent, at a lower cost than the conventional art, a large amount of hydraulic oil from flowing into one of the arm cylinder and the boom cylinder whose load pressure is lower.

Advantageous Effects of Invention

The present invention makes it possible to prevent, at a lower cost than the conventional art, a large amount of hydraulic oil from flowing into one of the arm cylinder and the boom cylinder whose load pressure is lower.

DESCRIPTION OF EMBODIMENTS

Figure 1:
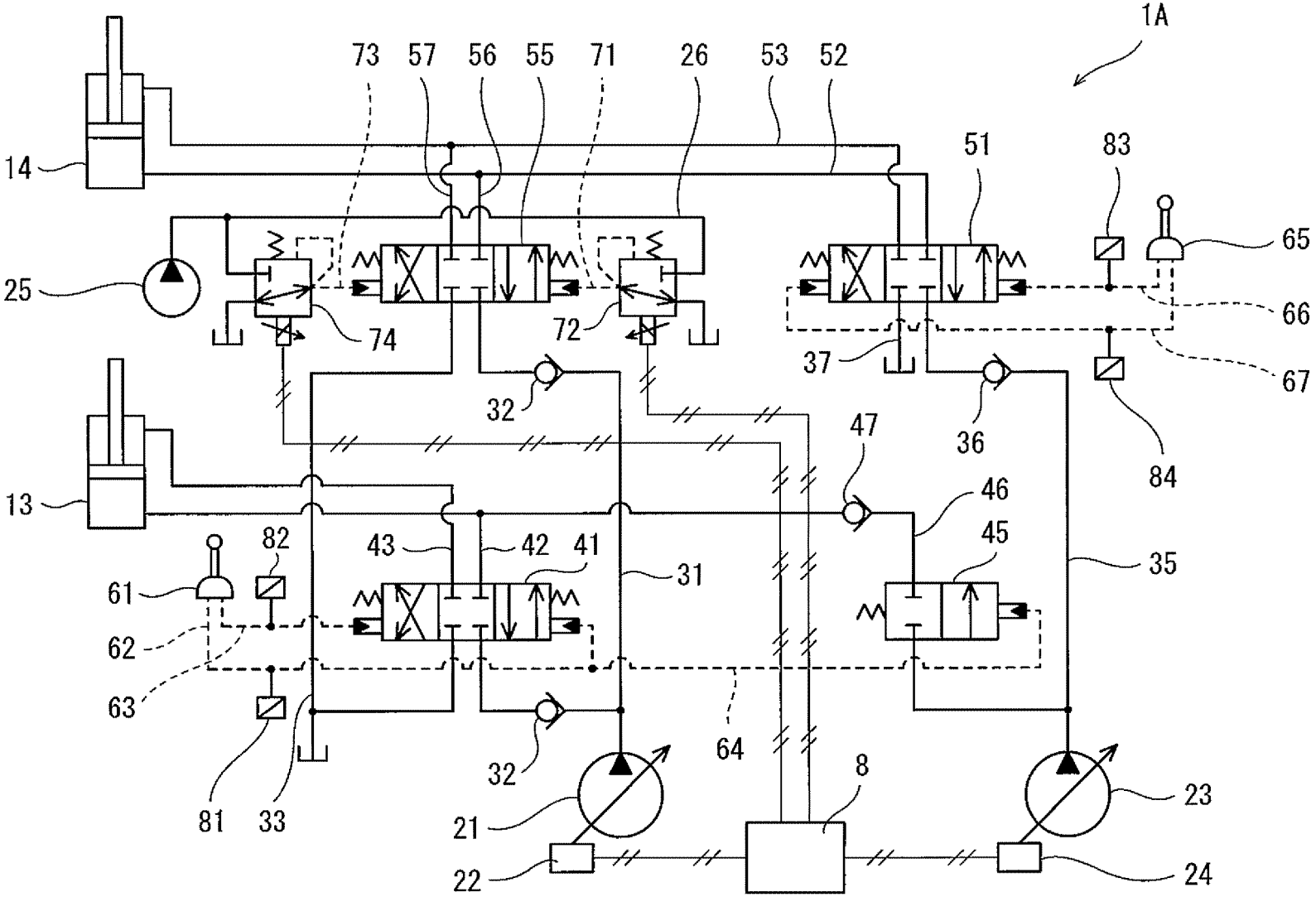
FIG. 1 shows a schematic configuration of a hydraulic excavator drive system according to Embodiment 1 of the present invention.
Figure 2:
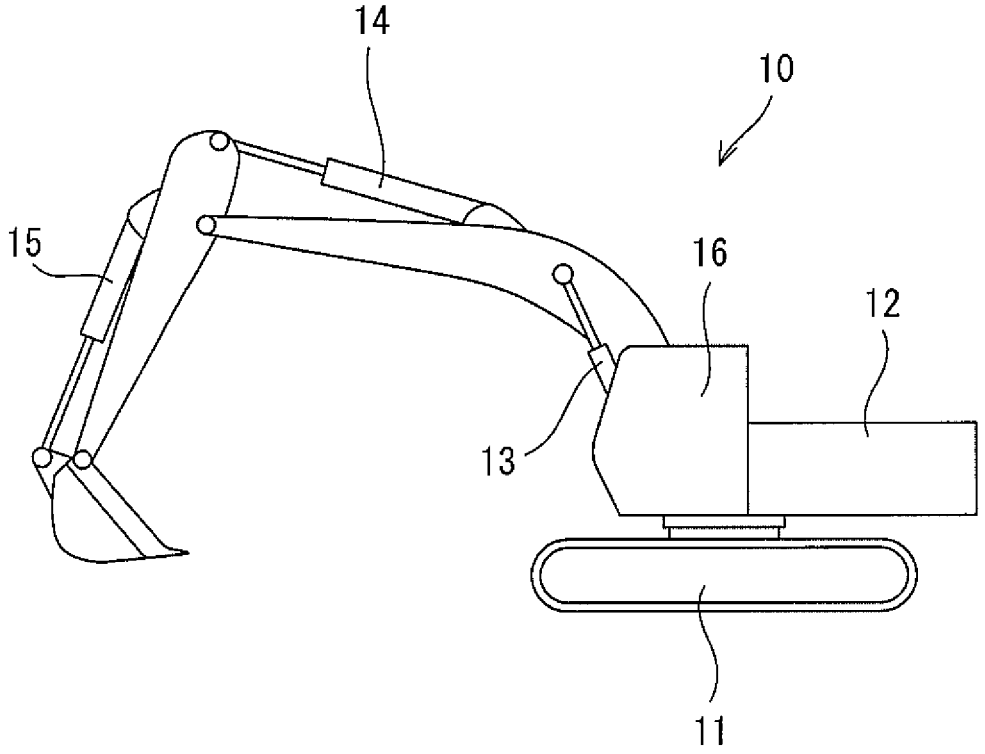
FIG. 2 is a side view of a hydraulic excavator.

FIG. 1 shows a hydraulic excavator drive system 1A according to Embodiment 1 of the present invention. FIG. 2 shows a hydraulic excavator 10, in which the drive system 1A is installed.

The hydraulic excavator 10 shown in FIG. 2 is a self-propelled hydraulic excavator, and includes a traveling unit 11. The hydraulic excavator 10 further includes a slewing unit 12 and a boom. The slewing unit 12 is slewably supported by the traveling unit 11. The boom is luffable relative to the slewing unit 12. An arm is swingably coupled to the distal end of the boom, and a bucket is swingably coupled to the distal end of the arm. The slewing unit 12 is equipped with a cabin 16 including an operator's seat. It should be noted that the hydraulic excavator 10 need not be a self-propelled machine.

The drive system 1A includes, as hydraulic actuators, a boom cylinder 13, an arm cylinder 14, and a bucket cylinder 15, which are shown in FIG. 2, and also includes an unshown slewing motor and an unshown pair of right and left travel motors. The boom cylinder 13 luffs the boom. The arm cylinder 14 swings the arm. The bucket cylinder 15 swings the bucket. It should be noted that, in FIG. 1, the illustration of hydraulic actuators other than the boom cylinder 13 and the arm cylinder 14 is omitted.

The drive system 1A further includes a first main pump 21 and a second main pump 23, which supply hydraulic oil to the above hydraulic actuators. The boom cylinder 13 is supplied with the hydraulic oil from the first main pump 21 and the second main pump 23 via a boom main control valve 41 and a boom auxiliary control valve 45. The arm cylinder 14 is supplied with the hydraulic oil from the second main pump 23 and the first main pump 21 via an arm main control valve 51 and an arm auxiliary control valve 55. Although not illustrated, regarding the other hydraulic actuators, for example, the bucket cylinder 15 is supplied with the hydraulic oil from the first main pump 21 via a bucket control valve, and the slewing motor is supplied with the hydraulic oil from the second main pump 23 via a slewing control valve.

Specifically, the boom main control valve 41, the arm auxiliary control valve 55, and the unshown bucket control valve are connected to the first main pump 21 by a first pump line 31, and the boom auxiliary control valve 45, the arm main control valve 51, and the unshown slewing control valve are connected to the second main pump 23 by a second pump line 35.

Each of the first main pump 21 and the second main pump 23 is a variable displacement pump (a swash plate pump or a bent axis pump) whose tilting angle is changeable. The tilting angle of the first main pump 21 is adjusted by a first regulator 22, and the tilting angle of the second main pump 23 is adjusted by a second regulator 24.

In the present embodiment, the delivery flow rate of the first main pump 21 and the delivery flow rate of the second main pump 23 are controlled by electrical positive control. Accordingly, each of the first regulator 22 and the second regulator 24 moves in accordance with an electrical signal. For example, in a case where the main pump (21 or 23) is a swash plate pump, the first regulator 22 or the second regulator 24 may electrically change the hydraulic pressure applied to a servo piston coupled to the swash plate of the main pump, or may be an electric actuator coupled to the swash plate of the main pump.

Alternatively, the delivery flow rate of the first main pump 21 and the delivery flow rate of the second main pump 23 may be controlled by hydraulic negative control. In this case, each of the first regulator 22 and the second regulator 24 moves in accordance with hydraulic pressure. Further alternatively, the delivery flow rate of the first main pump 21 and the delivery flow rate of the second main pump 23 may be controlled by load-sensing control.

The first pump line 31 includes a shared passage and a plurality of branch passages. The shared passage connects to the first main pump 21. The plurality of branch passages are branched off from the shared passage and connect to, for example, the boom main control valve 41 and the arm auxiliary control valve 55. Each of the branch passages is provided with a check valve 32.

The second pump line 35 includes a shared passage and a plurality of branch passages. The shared passage connects to the second main pump 23. The plurality of branch passages are branched off from the shared passage and connect to, for example, the boom auxiliary control valve 45 and the arm main control valve 51. The branch passage that connects to the boom auxiliary control valve 45 is not provided with a check valve, but the other branch passages of the second pump line 35 are each provided with a check valve 36.

Among the above control valves, the boom auxiliary control valve 45 is a two-position valve, whereas the other control valves are three-position valves. That is, the boom auxiliary control valve 45 includes one pilot port, whereas the other control valves than the boom auxiliary control valve 45 each include a pair of pilot ports. The boom auxiliary control valve 45 moves only when a boom raising operation is performed. All the control valves connected to the first main pump 21 are connected to a tank by a tank line 33. All the control valves connected to the second main pump 23, except the boom auxiliary control valve 45, are connected to the tank by a tank line 37.

A plurality of operation devices including a boom operation device 61 and an arm operation device 65 are disposed inside the aforementioned cabin 16. Each operation device includes an operating unit (an operating lever or a foot pedal) that receives an operation for moving a corresponding hydraulic actuator, and outputs an operation signal corresponding to an operating amount of the operating unit.

The boom operation device 61 outputs a boom operation signal whose magnitude corresponds to the inclination angle of the operating lever. The boom main control valve 41 moves in accordance with the boom operation signal outputted from the boom operation device 61. In the present embodiment, the boom operation device 61 is a pilot operation valve that outputs a pilot pressure as the boom operation signal. Accordingly, the pilot ports of the boom main control valve 41 are connected to the boom operation device 61 by a boom raising pilot line 62 and a boom lowering pilot line 63.

The boom main control valve 41 is connected to the boom cylinder 13 by a boom raising first supply line 42 and a boom lowering supply line 43. Although not illustrated, the boom raising first supply line 42 is provided with a lock valve for preventing the boom from being lowered due to its own weight. The boom auxiliary control valve 45 is connected, by a boom raising second supply line 46, to the boom raising first supply line 42 at a position between the unshown lock valve and the boom cylinder 13. The boom raising second supply line 46 is provided with a check valve 47, which allows a flow from the boom auxiliary control valve 45 toward the head side of the boom cylinder 13, but prevents the reverse flow.

When a boom raising operation is performed, the boom auxiliary control valve 45 moves together with the boom main control valve 41. In the present embodiment, the pilot port of the boom auxiliary control valve 45 is connected to the boom raising pilot line 62 by a pilot line 64. That is, when a boom raising operation is performed, a pilot pressure applied to the boom auxiliary control valve 45 is equal to a pilot pressure applied to the boom main control valve 41.

The arm operation device 65 outputs an arm operation signal whose magnitude corresponds to the inclination angle of the operating lever. The arm main control valve 51 moves in accordance with the arm operation signal outputted from the arm operation device 65. In the present embodiment, the arm operation device 65 is a pilot operation valve that outputs a pilot pressure as the arm operation signal. Accordingly, the pilot ports of the arm main control valve 51 are connected to the arm operation device 65 by an arm crowding pilot line 66 and an arm pushing pilot line 67.

The arm main control valve 51 is connected to the arm cylinder 14 by an arm crowding first supply line 52 and an arm pushing first supply line 53. The arm auxiliary control valve 55 is connected to the arm crowding first supply line 52 by an arm crowding second supply line 56 and connected to the arm pushing first supply line 53 by an arm pushing second supply line 57.

The pilot ports of the arm auxiliary control valve 55 are connected to a pair of solenoid proportional valves 72 and 74 by an arm crowding pilot line 71 and an arm pushing pilot line 73. The solenoid proportional valves 72 and 74 are connected to an auxiliary pump 25 by a primary pressure line 26.

Each of the solenoid proportional valves 72 and 74 is a direct proportional valve whose output secondary pressure and a command current fed thereto indicate a positive correlation. Alternatively, each of the solenoid proportional valves 72 and 74 may be an inverse proportional valve whose output secondary pressure and the command current fed thereto indicate a negative correlation.

The arm auxiliary control valve 55 is controlled by a controller 8 via the solenoid proportional valves 72 and 74. For example, the controller 8 is a computer that includes a CPU and memories such as a ROM and RAM. The CPU executes a program stored in the ROM.

The aforementioned boom raising pilot line 62 and boom lowering pilot line 63 are provided with pressure sensors 81 and 82, respectively, each of which detects a pilot pressure that is a boom operation signal outputted from the boom operation device 61. Similarly, the aforementioned arm crowding pilot line 66 and arm pushing pilot line 67 are provided with pressure sensors 83 and 84, respectively, each of which detects a pilot pressure that is an arm operation signal outputted from the arm operation device 65. The pressure sensors 81 to 84 are electrically connected to the controller 8. It should be noted that FIG. 1 shows only part of signal lines for simplifying the drawing.

The controller 8 controls the above-described first regulator 22 and second regulator 24, such that the delivery flow rate of the first main pump 21 and the delivery flow rate of the second main pump 23 increase in accordance with increase in the pilot pressure (boom operation signal) outputted from the boom operation device 61. Similarly, the controller 8 controls the above-described second regulator 24 and first regulator 22, such that the delivery flow rate of the second main pump 23 and the delivery flow rate of the first main pump 21 increase in accordance with increase in the pilot pressure (arm operation signal) outputted from the arm operation device 65.

When an arm crowding operation is performed without a boom raising operation being performed (i.e., when the pilot pressure of the boom raising pilot line 62 detected by the pressure sensor 81 is lower than a threshold, but the pilot pressure of the arm crowding pilot line 66 detected by the pressure sensor 83 is higher than a threshold), the controller 8 moves the arm auxiliary control valve 55 together with the arm main control valve 51. That is, the controller 8 increases an electric current fed to the solenoid proportional valve 72 in accordance with increase in the pilot pressure detected by the pressure sensor 83.

On the other hand, when an arm crowding operation is performed concurrently with a boom raising operation (i.e., when the pilot pressure of the boom raising pilot line 62 detected by the pressure sensor 81 is higher than the threshold, and the pilot pressure of the arm crowding pilot line 66 detected by the pressure sensor 83 is also higher the threshold), the controller 8 does not move the arm auxiliary control valve 55. That is, the controller 8 feeds no electric current to the solenoid proportional valve 72.

When an arm pushing operation is performed (i.e., when the pilot pressure of the arm pushing pilot line 67 detected by the pressure sensor 84 is higher than a threshold), the controller 8 moves the arm auxiliary control valve 55 together with the arm main control valve 51 regardless of whether or not a boom raising operation or a boom lowering operation is performed. That is, the controller 8 increases an electric current fed to the solenoid proportional valve 74 in accordance with increase in the pilot pressure detected by the pressure sensor 84.

As described above, in the drive system 1A of the present embodiment, when an arm crowding operation and a boom raising operation are performed concurrently, the arm auxiliary control valve 55 does not move. Therefore, the first main pump 21 can be used dedicatedly for the boom cylinder 13. On the other hand, regarding the second main pump 23, normally, when an arm crowding operation and a boom raising operation are performed concurrently, the load pressure of the boom cylinder 13 is higher than the load pressure of the arm cylinder 14. Accordingly, even when the boom auxiliary control valve 45 moves together with the boom main control valve 41, the check valve 47 provided on the boom raising second supply line 46 blocks the supply of the hydraulic oil from the boom auxiliary control valve 45 to the boom cylinder 13. Therefore, the second main pump 23 can be used dedicatedly for the arm cylinder 14. Here, the term "dedicatedly" is intended to exclude only one of the arm cylinder 14 and the boom cylinder 13, and is not necessarily intended to exclude the other hydraulic actuators (e.g., the bucket cylinder 15 and the unshown slewing motor).

Figure 6:
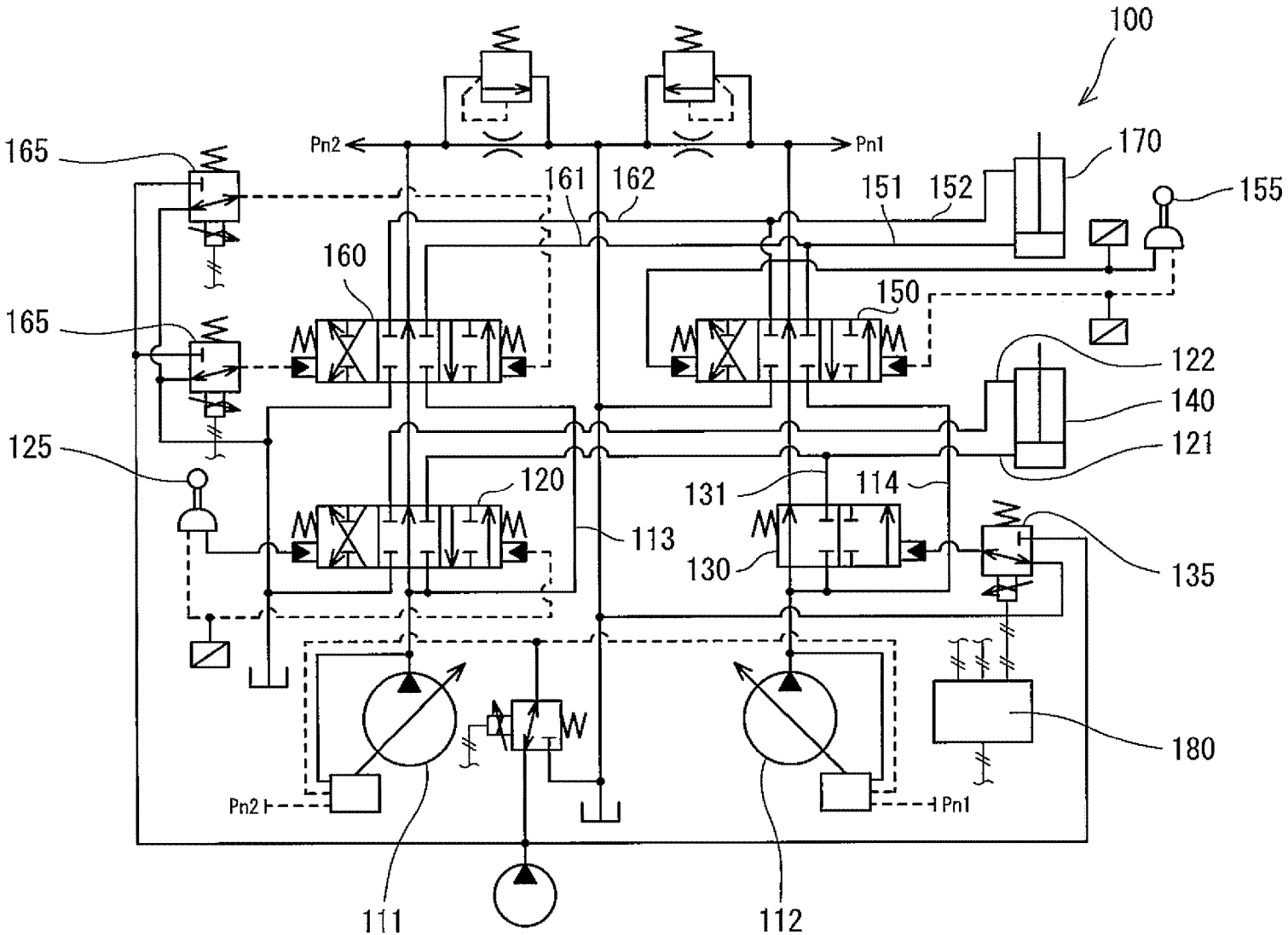
FIG. 6 shows a schematic configuration of a conventional hydraulic excavator drive system.

That is, according to the drive system 1A of the present embodiment, the number of solenoid proportional valves can be reduced by 1 compared to the conventional drive system 100 shown in FIG. 6. This makes it possible to prevent, at a lower cost than the conventional art, a large amount of hydraulic oil from flowing into one of the arm cylinder 14 and the boom cylinder 13 whose load pressure is lower.

Moreover the check valve 47 is provided not on the branch passage of the second pump line 35, the branch passage connecting to the boom auxiliary control valve 45, but on the boom raising second supply line 46. Accordingly, when the position of the boom is kept as it is, the hydraulic oil does not pass through the boom auxiliary control valve 45. Therefore, the amount of leakage of the hydraulic oil can be reduced, which makes it possible to reduce the lowering of the boom that is caused over time by its own weight.

Furthermore, since the delivery flow rate of the first main pump 21 and the delivery flow rate of the second main pump 23 can be controlled independently of each other, the delivery flow rate of each of these main pumps can be controlled dedicatedly for a corresponding one of the boom cylinder 13 and the arm cylinder 14. Here, the term "dedicatedly" has the same meaning as in three paragraphs earlier. Therefore, the occurrence of unnecessary pressure loss can be prevented in a path from the first main pump 21 to the boom cylinder 13 and in a path from the second main pump 23 to the arm cylinder 14, and thereby wasteful energy consumption can be suppressed.

<Variations>

Figure 3:
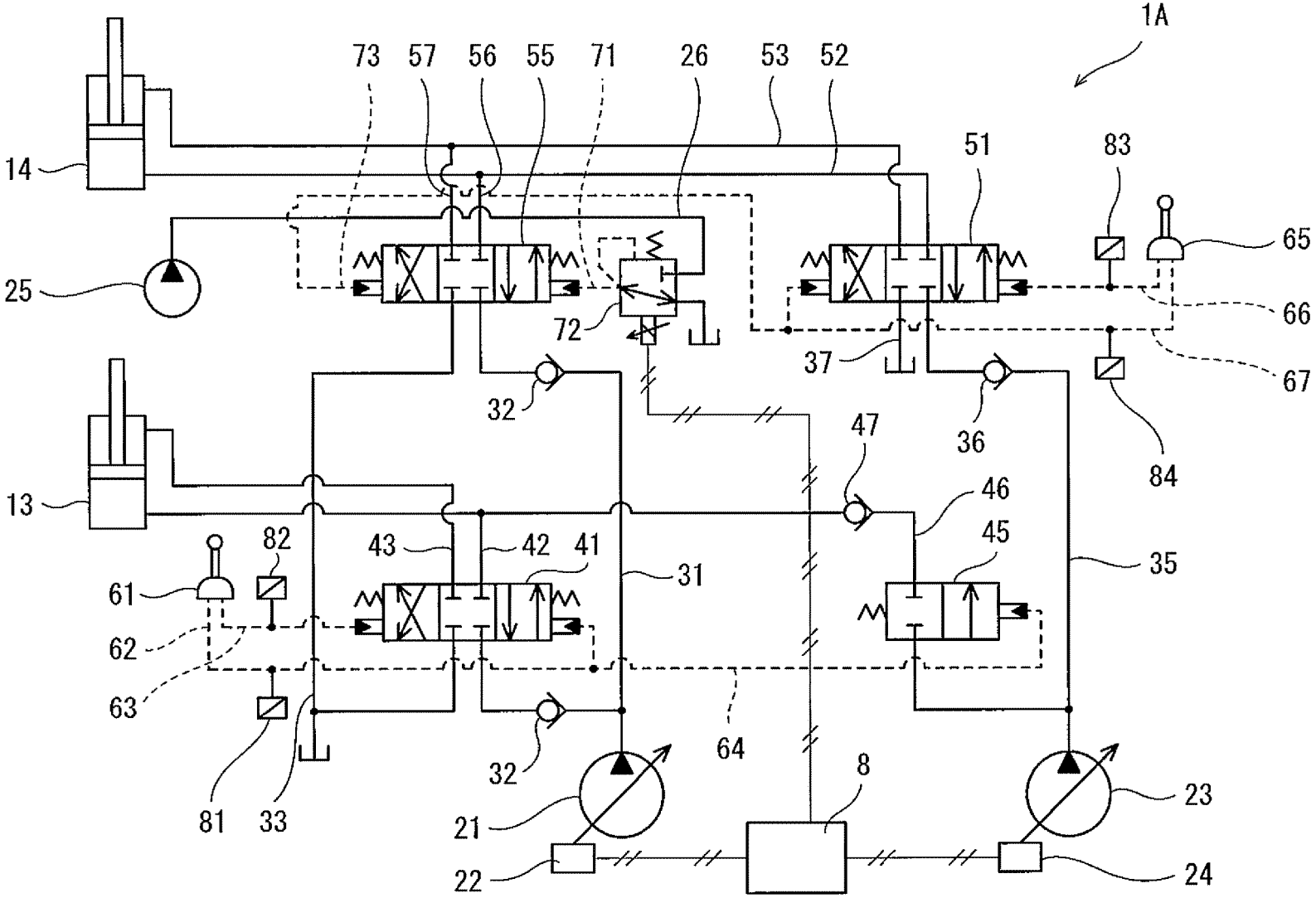
FIG. 3 shows a schematic configuration of the hydraulic excavator drive system according to a variation of Embodiment 1.

In the above-described embodiment, when an arm crowding operation is performed and when an arm pushing operation is performed, the controller 8 controls the arm auxiliary control valve 55 via the solenoid proportional valve 72 or 74. However, this is a non-limiting example. It will suffice if the controller 8 controls the arm auxiliary control valve 55 via a solenoid proportional valve at least when an arm crowding operation is performed. For example, as shown in FIG. 3, the arm pushing pilot line 73 of the arm auxiliary control valve 55 may be connected to the arm pushing pilot line 67 of the arm main control valve 51.

Embodiment 2

Figure 4:
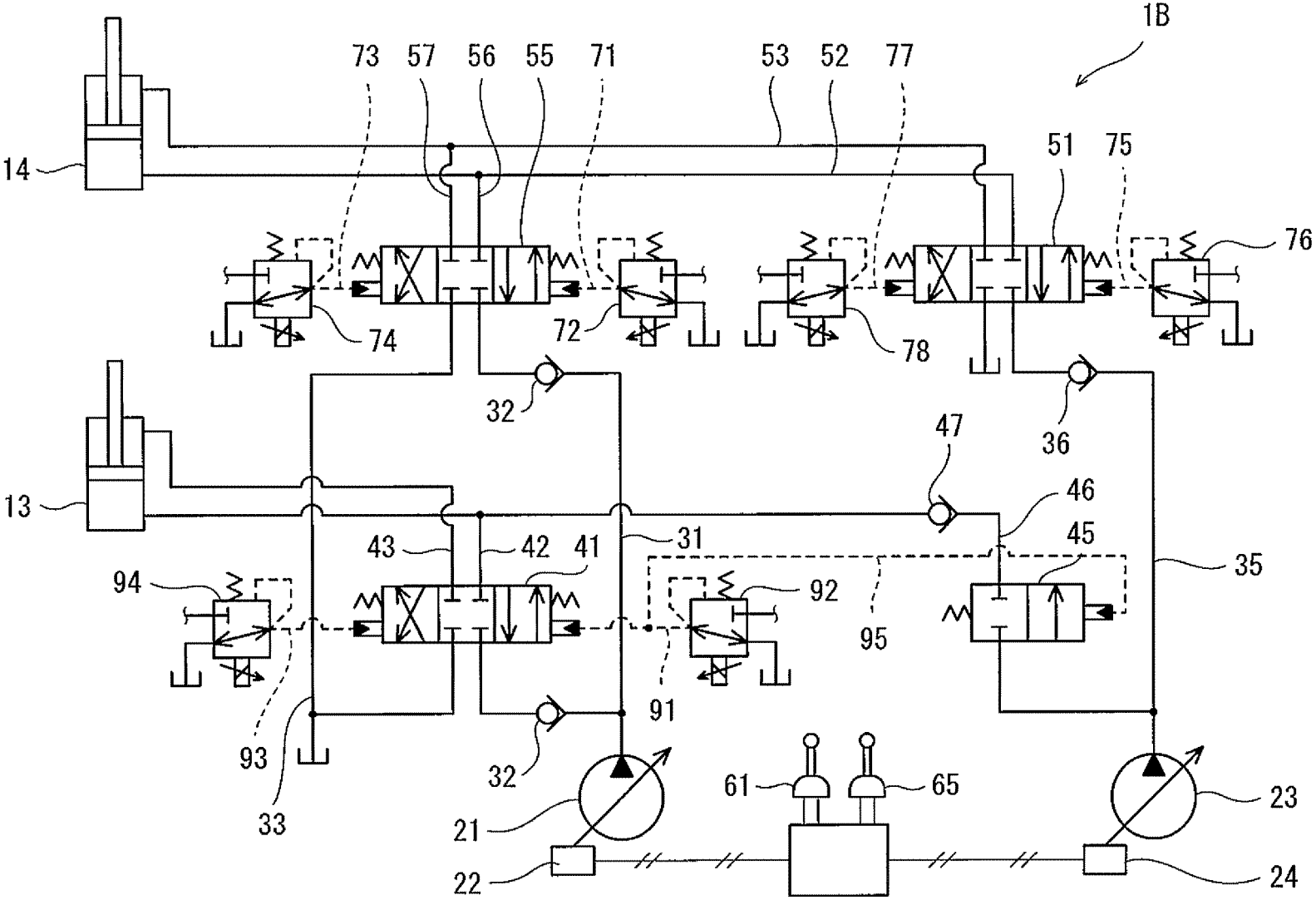
FIG. 4 shows a schematic configuration of a hydraulic excavator drive system according to Embodiment 2 of the present invention.

FIG. 4 shows a hydraulic excavator drive system 1B according to Embodiment 2 of the present invention. It should be noted that, in the present embodiment, the same components as those described in Embodiment 1 are denoted by the same reference signs as those used in Embodiment 1, and repeating the same descriptions is avoided.

In the present embodiment, each of the boom operation device 61 and the arm operation device 65 is an electrical joystick that outputs an electrical signal as an operation signal to the controller 8. Accordingly, the pilot ports of the arm main control valve 51 are connected to a pair of solenoid proportional valves 76 and 78 by an arm crowding pilot line 75 and an arm pushing pilot line 77. Similarly, the pilot ports of the boom main control valve 41 are connected to a pair of solenoid proportional valves 92 and 94 by a boom raising pilot line 91 and a boom lowering pilot line 93.

The pilot port of the boom auxiliary control valve 45 is connected to the boom raising pilot line 91 by a pilot line 95. Also in this configuration, the boom auxiliary control valve 45 moves together with the boom main control valve 41 when a boom raising operation is performed.

The present embodiment provides the same advantageous effects as those provided by Embodiment 1.

Figure 5:
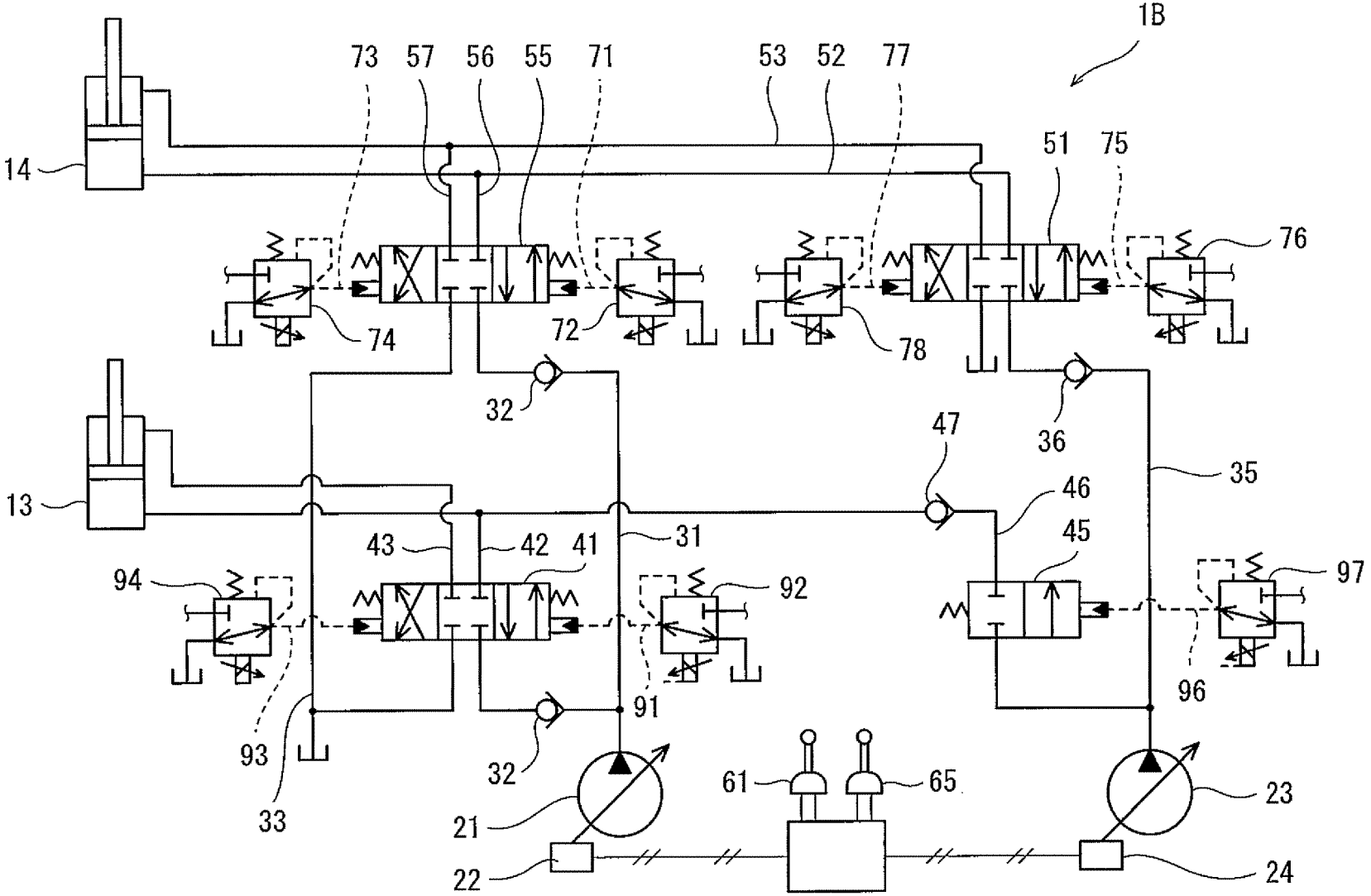
FIG. 5 shows a schematic configuration of the hydraulic excavator drive system according to a variation of Embodiment 2.

In a case where each of the boom operation device 61 and the arm operation device 65 is an electrical joystick as in the present embodiment, a solenoid proportional valve 97 dedicated for the boom auxiliary control valve 45 may be adopted as shown in FIG. 5. The solenoid proportional valve 97 is connected to the pilot port of the boom auxiliary control valve 45 by a pilot line 96. According to this configuration, the solenoid proportional valve 97 dedicated for the boom auxiliary control valve 45 can be controlled in the same manner as the control of the solenoid proportional valve 92 dedicated for the boom main control valve 41 although the number of solenoid proportional valves cannot be reduced. Further, the pilot line 96 of the boom auxiliary control valve 45 in the configuration shown in FIG. 5 is shorter than the pilot line 64 of the boom auxiliary control valve 45 in the configuration shown in FIG. 1, in which the pilot line 64 of the boom auxiliary control valve 45 is connected to the boom raising pilot line 62 of the boom main control valve 41. This feature provides a significant advantageous effect in terms of saving space in a structure in which solenoid proportional valves are disposed in close proximity to control valves.

Other Embodiments

The present invention is not limited to the above-described embodiments. Various modifications can be made without departing from the scope of the present invention.

For example, in each of Embodiment 1 and Embodiment 2, upstream of all the branch passages of the first pump line 31, a center bypass line may be branched off from the first pump line 31. The center bypass line may pass through all the control valves connected to the branch passages of the first pump line 31, and connect to the tank. Similarly, upstream of all the branch passages of the second pump line 35, a center bypass line may be branched off from the second pump line 35. The center bypass line may pass through all the control valves connected to the branch passages of the second pump line 35, and connect to the tank.

REFERENCE SIGNS LIST

1 hydraulic excavator drive system
13 boom cylinder
14 arm cylinder
21 first main pump

23 second main pump
31 first pump line
35 second pump line
41 boom main control valve
42 boom raising first supply line
43 boom lowering supply line
45 boom auxiliary control valve
46 boom raising second supply line
47 check valve
51 arm main control valve
52 arm crowding first supply line
53 arm pushing first supply line
55 arm auxiliary control valve
56 arm crowding second supply line
57 arm pushing second supply line
8 controller

The invention claimed is:

1. A hydraulic excavator drive system comprising:

a boom main control valve connected to a boom cylinder by a boom raising first supply line and a boom lowering supply line;

a boom auxiliary control valve connected to the boom raising first supply line by a boom raising second supply line, the boom auxiliary control valve moving together with the boom main control valve when a boom raising operation is performed;

an arm main control valve connected to an arm cylinder by an arm crowding first supply line and an arm pushing first supply line;

an arm auxiliary control valve connected to the arm crowding first supply line by an arm crowding second supply line and connected to the arm pushing first supply line by an arm pushing second supply line;

a first pump connected to the boom main control valve and the arm auxiliary control valve by a first pump line;

a second pump connected to the boom auxiliary control valve and the arm main control valve by a second pump line; and a controller that controls the arm auxiliary control valve via a solenoid proportional valve at least when an arm crowding operation is performed, the controller moving the arm auxiliary control valve together with the arm main control valve when the arm crowding operation is performed without the boom raising operation being performed, but not moving the arm auxiliary control valve when the arm crowding operation and the boom raising operation are performed concurrently, wherein the boom raising second supply line is provided with a check valve that allows a flow from the boom auxiliary control valve toward a head side of the boom cylinder, but prevents a reverse flow.

2. The hydraulic excavator drive system according to claim 1, wherein the boom main control valve includes:

a first pilot port connected to a boom raising pilot line; and a second pilot port connected to a boom lowering pilot line, and the boom auxiliary control valve includes a pilot port that is connected to another pilot line that is directly connected to the boom raising pilot line.

3. The hydraulic excavator drive system according to claim 2, wherein a pilot pressure applied to the pilot port of the boom auxiliary control valve is equal to a pilot pressure applied to the first pilot port of the boom main control valve when the boom raising operation is performed.

* * * * *